US006789917B2

(12) United States Patent
Parsons et al.

(10) Patent No.: US 6,789,917 B2
(45) Date of Patent: Sep. 14, 2004

(54) DUAL MODE RECHARGEABLE FLASHLIGHT

(75) Inventors: Kevin L. Parsons, Appleton, WI (US); W. Clay Reeves, Carrollton, TX (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 10/140,430

(22) Filed: May 6, 2002

(65) Prior Publication Data

US 2003/0206410 A1 Nov. 6, 2003

(51) Int. Cl.[7] ..... F21L 4/02; F21L 4/08

(52) U.S. Cl. ..... 362/184; 362/183; 362/200; 362/205; 362/228

(58) Field of Search ..... 362/183–186, 362/200, 202, 205, 228, 251, 20

(56) References Cited

U.S. PATENT DOCUMENTS

| | | | | | |
|---|---|---|---|---|---|
| 4,225,906 | A | | 9/1980 | Gulliksen et al. | 362/254 |
| 4,249,234 | A | | 2/1981 | Park et al. | 362/228 |
| 4,605,993 | A | * | 8/1986 | Zelina, Jr. | 362/183 |
| 4,782,432 | A | | 11/1988 | Coffman | 362/184 |
| 4,803,605 | A | | 2/1989 | Schaller et al. | 362/184 |
| 4,831,504 | A | | 5/1989 | Nishizawa et al. | 362/100 |
| 5,010,454 | A | * | 4/1991 | Hopper | 362/184 |
| 5,077,644 | A | | 12/1991 | Schaller et al. | 362/184 |
| 5,272,606 | A | * | 12/1993 | Blaney | 362/205 |
| 5,384,693 | A | | 1/1995 | Schwaller et al. | 362/184 |
| 5,629,105 | A | | 5/1997 | Matthews | 429/97 |
| 5,645,341 | A | | 7/1997 | Liao | 362/183 |
| 5,684,378 | A | | 11/1997 | Furth et al. | 320/2 |
| 5,806,961 | A | | 9/1998 | Dalton et al. | 362/183 |
| 6,095,661 | A | | 8/2000 | Lebens et al. | 362/184 |
| 6,168,288 | B1 | | 1/2001 | St. Claire | 362/184 |
| 6,231,207 | B1 | * | 5/2001 | Kennedy et al. | 362/158 |
| 6,250,771 | B1 | | 6/2001 | Sharrah et al. | 362/184 |
| 6,286,976 | B1 | * | 9/2001 | Chopra et al. | 362/183 |
| 6,296,367 | B1 | | 10/2001 | Parsons et al. | 362/183 |
| 2003/0179573 | A1 | * | 9/2003 | Chun | 362/200 |

* cited by examiner

*Primary Examiner*—Alan Cariaso
(74) *Attorney, Agent, or Firm*—Welsh & Katz, Ltd.

(57) ABSTRACT

A dual mode rechargeable flashlight includes a generally rectangular housing sized to be readily carried and operated in one's hand and having a pair of upper and lower frame members that receive and retain generally planar rectangular panels preferably made of anodized aluminum and which may be of selective colors and have indicia imprinted thereon. An integral charging system within the flashlight housing enables recharging of DC batteries connectable in circuit with a high intensity lamp carried within a reflector assembly at a forward lens end of the flashlight. A modular self-storing blade assembly facilitates connection of the charging system to an electrical outlet. A power pack support housing within the flashlight is accessible through an access door to enable insertion of a 6-volt DC battery power pack connectable in circuit with a high intensity long life LED carried within the reflector assembly. Selective actuation of a switch button effects energizing of either the high intensity lamp or the high luminous intensity LED.

53 Claims, 9 Drawing Sheets

DUAL MODE RECHARGEABLE FLASHLIGHT

FIELD OF THE INVENTION

The present invention relates generally to flashlights, and more particularly to a small size hand holdable flashlight selectively operable in a dual mode so as to energize a high intensity Xenon bulb through a rechargeable battery power source or to energize a high intensity LED.

BACKGROUND OF THE INVENTION

Conventional general-purpose flashlights are well known and find wide application by both law enforcement personnel and civilians. Conventional flashlights generally include an incandescent light bulb and dry cell batteries disposed in an elongated tubular casing typically consisting of a body section and a head section. Flashlights of this type are often bulky and cumbersome. The size and weight of such conventional flashlights inhibit the mobility of law enforcement personnel when carried along with other law enforcement equipment, and sometimes leads to the flashlight being purposely or inadvertently left behind. This presents a problem when the need for a flashlight arises and one is not readily accessible. Similarly, for personal use lighting, conventional bulky flashlights do not lend themselves to being carried at times when conditions suggest that a flashlight be carried on one's person in the event one loses his/her way during walking or hiking in unfamiliar territory, or when backpacking and camping where the weight of equipment is a significant factor. Even in home use, a conventional bulky flashlight is generally kept in an inconspicuous place so that in time of emergency, or in impending situations where it is known that a flashlight may be needed, it is not convenient to retrieve the flashlight and carry it on one's person.

Due the very nature of flashlights that employ dry cell batteries, there comes a time when the batteries are virtually exhausted or discharge and do not maintain the associated light bulb with sufficient energy to create a worthwhile beam of light. In this instance, it would be highly desirable to have a second discrete high intensity source of light that could be used for a temporary period of time and has a long life power source due to low voltage requirements of the high intensity light, can provide lighting until either the batteries for the primary high intensity bulb can be replaced or recharged.

Flashlights are known that carry rechargeable batteries that can be recharged without removing the batteries from the flashlight. Moreover, flashlights are known that employ two bulbs with one bulb being in a backup circuit in the event the first bulb expires by burning out. These known flashlights, however, exhibit a disadvantage in that they are relatively bulky and heavy and do not lend themselves to being readily carried on one's person for significant periods of time. Accordingly, a flashlight that is of small size so as to be readily carried in the palm of one's hand, and that can also be carried in a small case or the like carried on one's belt or in a pocket, and that further employs a high intensity bulb energized by rechargeable batteries internally of the flashlight and chargeable without removal from the flashlight, as well as having a high intensity LED powered by a modular replaceable power pack, would offer significant advantages over the prior known flashlights.

BRIEF SUMMARY OF THE INVENTION

One of the primary objects of the present invention is provide a dual mode rechargeable flashlight of relatively small size that can be readily carried on one's person.

A more particular object of the present invention is to provide a dual mode rechargeable flashlight that is operable in a first mode to activate a brilliant Xenon lamp in a first position of a switch button on the flashlight, and energize a long life solid state LED beam that creates a highly visible light responsive to movement of the light switch to a second position effecting a second mode of operation.

Another object of the present invention is to provide a small hand holdable flashlight having the aforedescribed characteristics but also having a modular self-storing blade assembly that is normally self-storing within the flashlight housing and can be removed and rotated to facilitate connection to an electrical receptacle for charging a rechargeable power source within the flashlight.

Still another object of the present invention is to provide a relatively small flashlight having a generally rectangular housing that can be readily held within the palm of one's hand and that provides dual mode operation of either a high intensity Xenon bulb through a rechargeable battery charging system without removing the batteries from the flashlight, and that also has a high intensity LED energized by a modular replaceable power pack carried in the flashlight housing in response to selective movement of a switch exposed externally of the flashlight housing.

Still another object of the present invention is to provide a relatively small compact flashlight as aforedescribed employing a polycarbonate lens having a curvature such that energizing the high intensity LED enables the flashlight to be observed from a substantial distance from the user, as well as being observed from a position disposed approximately 90° from the axis of the flashlight.

A feature of the flashlight in accordance with the present invention lies in the utilization of a flashlight frame adapted to support panel members that may be of different colors than the flashlight frame so as to provide an aesthetically attractive flashlight.

Another feature of the present invention lies in providing a small size flashlight as aforedescribed wherein the panel members facilitate printing or other indicia being placed on the exposed surfaces of the panels to provide a personal and pleasing inscription or promotional inscription.

A further feature of the flashlight in accordance with the present invention lies in the combination within the flashlight of a power pack receiving housing for supporting a power supply to a high intensity LED upon selective actuation of a switch, and which also has a rechargeable battery source and means for charging the battery source as a component of the flashlight without removing the batteries from internally of the flashlight housing.

Still another feature of the flashlight in accordance with the present invention lies in the ability to utilize either a battery recharging module for use with electrical receptacles in the United States, or a modular adaptor enabling recharging with receptacles as in many countries outside the United States.

Still another feature of the flashlight in accordance with the present invention, lies in the provision of a relatively compact small flashlight housing that employs generally rectangular frame members and associated rectangular panels and that are mutually cooperable to establish a flashlight housing along the periphery of which a trim belt may be applied that protects the housing and improves frictional contact between the user's hand and the flashlight.

Further objects, advantages and features of the present invention will become apparent from the following detailed description taken in conjunction with the accompanying drawing wherein like reference numerals designate like elements throughout the several views.

DETAILED DESCRIPTION OF THE INVENTION

Figure 1:
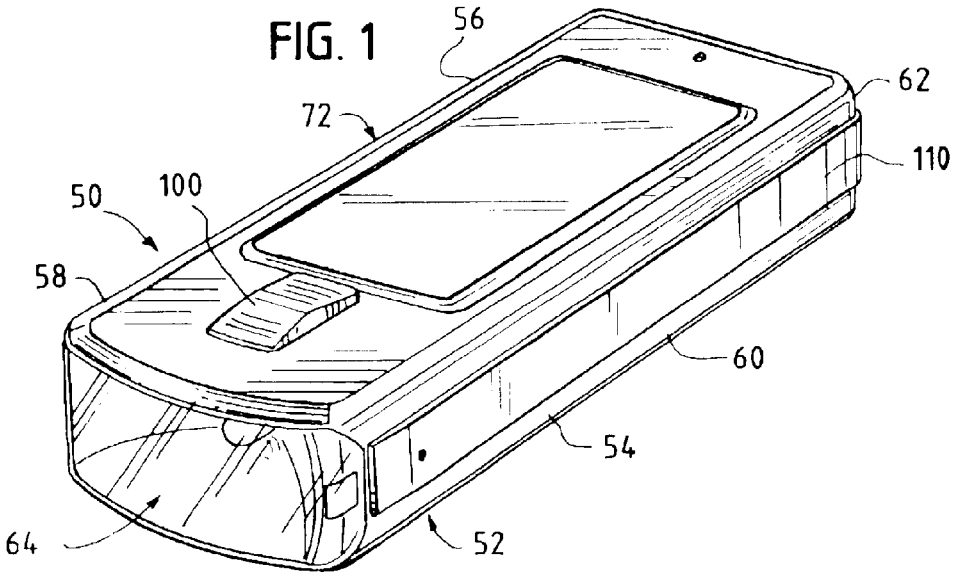
FIG. 1 is a perspective view of a dual mode rechargeable flashlight constructed in accordance with the present invention.

Referring now the drawings, and in particular to FIGS. 1–4, a flashlight constructed in accordance with a preferred embodiment of the present invention is indicated generally at 50. As will be described, the flashlight 50 is operative in a dual mode to enable selective energizing of a high intensity lamp by a rechargeable power source, or energizing of a long life LED crystal light through a power supply in the form of a replaceable battery pack.

Briefly, the flashlight 50 includes a generally rectangular housing, indicated generally at 52, sized to be readily carried and operated in one's hand. For example, one embodiment utilizes a rectangular housing having a longitudinal length of approximately about 4 inches, a transverse width of approximately about 1⅝ inches, and a thickness of approximately about ¾ inches. The housing 50 is defined by laterally spaced sides 54 and 56 that intersect a top surface 58, a bottom surface 60 a transverse rear surface 62 and a front lens light emitting end 64. It will be understood that reference to the "top" and "bottom" surfaces 58 and 60 are for purposes of description only, and that the flashlight 50 may be readily operated with the top surface 58 facing downwardly or in a inclined direction when grasped in a user's hand.

Figure 4:
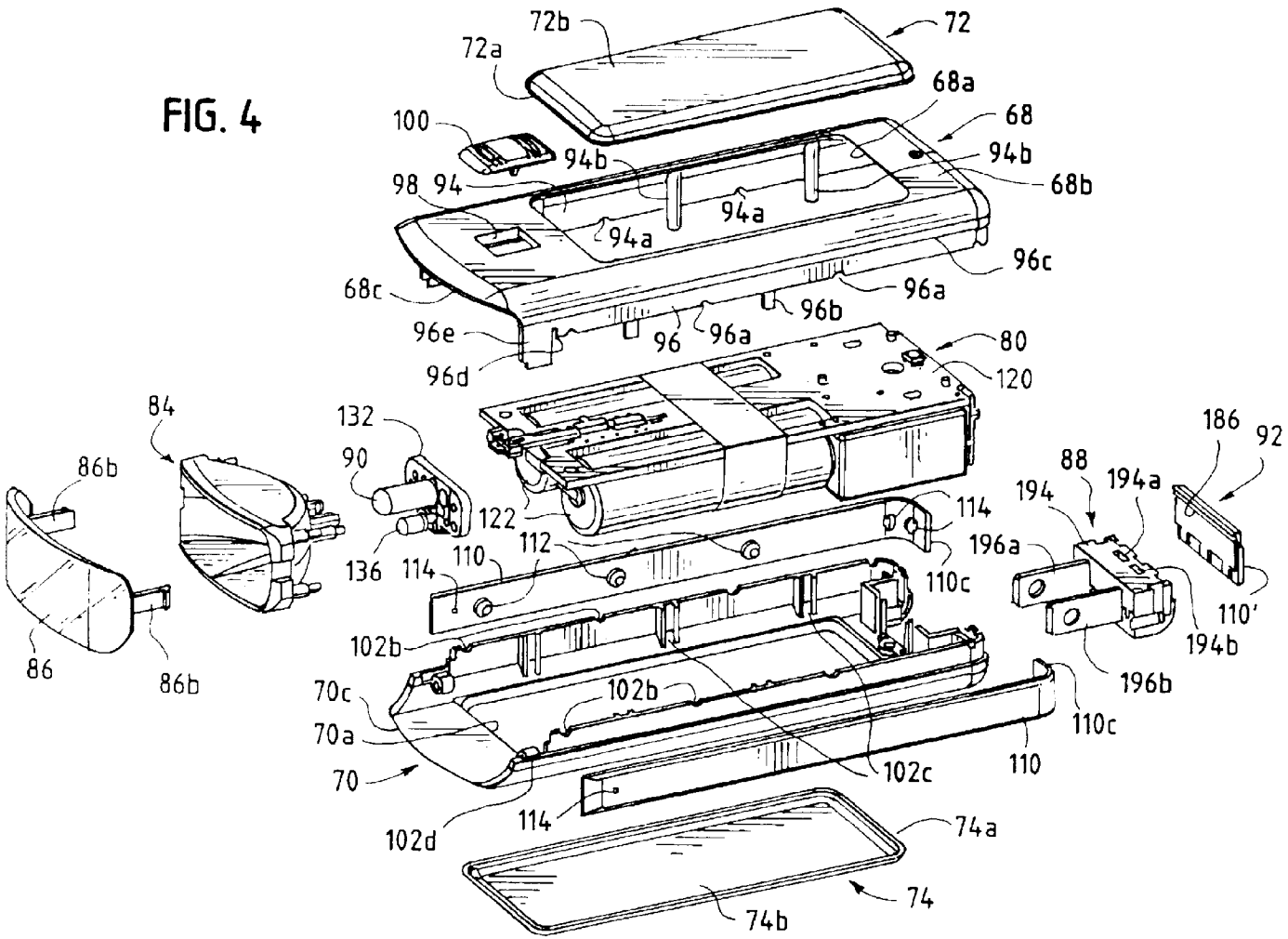
FIG. 4 is an exploded perspective view of the flashlight of FIG. 1.
Figure 5:
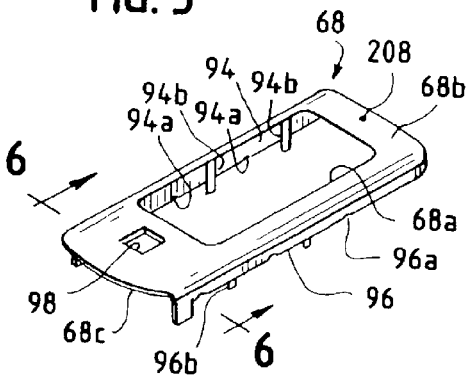
FIG. 5 is a perspective view of the top frame member portion of the housing for the flashlight of FIG. 1.

With particular reference to FIG. 4, the housing 52 includes a pair of upper and lower frame members 68 and 70, respectively, that are preferably made of a molded polycarbonate material. Each frame member 68 and 70 has a generally rectangular opening therein, as indicated at 68*a* and 70*a*, respectively, sized and configured to receive and retain generally planar panels 72 and 74, respectively. The panels 72 and 74 are preferably made of a forged anodized aluminum and are adapted to have predetermined colors applied thereto or have other indicia imprinted thereon or emblems attached thereto.

The frame members 68 and 70, together with their respective panels 72 and 74, are adapted to be connected in mutually engaging relation so as to define an internal chamber or cavity that receives and supports an integral charging system, indicated generally at 80. The housing 50 also carries an internal housing for releasably receiving a power source in the form of a DC battery power pack 82. The housing 50 supports a parabolic reflector and light source assembly, indicated generally at 84, and a high impact polycarbonate outwardly convexly curved lens 86 on the forward light-emitting end of the housing. The housing formed by the frame members 68 and 70 and the associated panels 72 and 74 is adapted to receive a modular self-storing blade assembly, indicated generally at 88, within the rear end of the housing. As will be described, the self-storing blade assembly 88 facilitates connection of the integral charging system 80 to an electrical outlet to charge a rechargeable power source for a high intensity 3-volt lamp, such as indicated at 90 in FIG. 4, through a suitable AC to DC rectifier. An access door or cover 92 is pivotally connected to the rear end of the housing 52 so as to cover an access opening in a power pack receiving housing while facilitating exposure of the power pack receiving housing to facilitate replacement of a battery pack.

Figure 6:
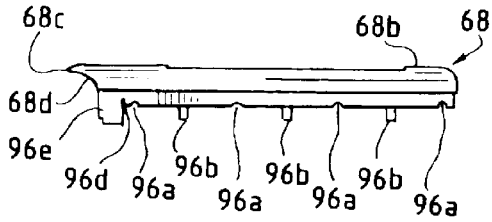
FIG. 6 is a side elevational view of the frame member of FIG. 5.
Figure 7:
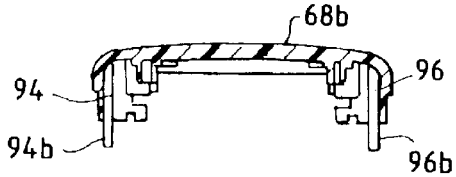
FIG. 7 is a transverse sectional view, on an enlarged scale, taken substantially along line 7-7 of FIG. 5.
Figure 8:
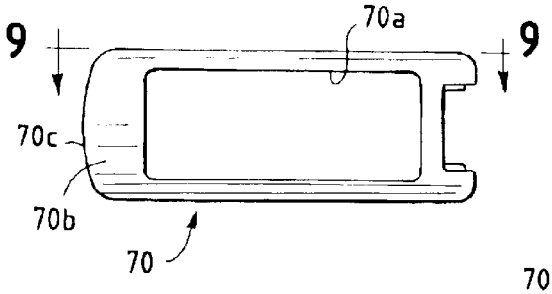
FIG. 8 is a plan view of the bottom frame member portion of the housing for the flashlight of FIG. 1.

Turning now to a more detailed description of the various components of the flashlight 50, and in particular in FIGS. 5–11, the upper frame member 68 preferably has an upper surface 68*b* that is slightly upwardly curved or convex, as considered in transverse cross section, and has substantially parallel radiused longitudinal marginal edge surfaces formed integral with downwardly depending generally planar wall portions 94 and 96. As illustrated in FIG. 6, the wall portions 94, 96 have semi-circular recesses 94*a* and 96*a*, respectively, formed along their lower marginal edges. Each wall 94 and 96 has a plurality of integral preferably cylindrical-shaped guide pins, indicated at 94*b* and 96*b*, respectively, that are adapted for cooperating relation with the lower frame member 70 to facilitate a predetermined assembled relation therewith. The forward end of the upper frame member 68 has a rectangular opening 98 therethrough adapted to receive a manually operable switch actuating button or knob as indicated at 100 in FIG. 1. The forward end of the upper frame member 68 also is formed with a generally convex edge curvature 68*c* that establishes laterally spaced concave profile edge surfaces, such as indicated at 68*d* in FIG. 6.

Figure 10:
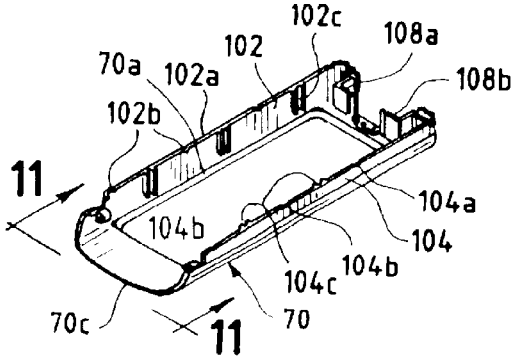
FIG. 10 is a perspective view showing the opposite side of the bottom frame member of FIG. 8.

The lower frame member 70 is generally similar in configuration to the upper frame member 66 but has a rectangular opening 70*a* of greater longitudinal length than the rectangular opening 68*a* in the upper frame member. The lower frame member 70 has an overall longitudinal length equal to the longitudinal length of the upper frame member 68 and has a transverse width equal to the transverse width of the upper frame member 68. The lower frame member 70 has rounded or radiused longitudinal marginal edges similar to the upper frame surface 68 that terminate in generally planar parallel walls 102 and 104 having upper marginal edges 102*a* and 104*a*, respectively, dimensioned to abut the lower marginal edges of the walls 94 and 96 of the upper frame member when assembled therewith. In similar fashion to the upper frame member 68, the walls 102 and 104 of the lower frame member have semi-circular recesses 102*b* and 104*b*, respectively, formed in spaced relation along the upper marginal edges 102*a* and 104*a* so that when the upper and lower frame members are in assembled relation, the semi-circular recesses are matched to form circular openings in the sides of the resulting frame. As illustrated in FIG. 10, the walls 102 and 104 of the lower frame member 70 have pairs of guides 102*c* and 104*c* that establish slots to receive the guide pins 94*b* and 96*b* on the upper frame member so as to effect the desired assembled relationship between the upper and lower frame members.

Figure 11:
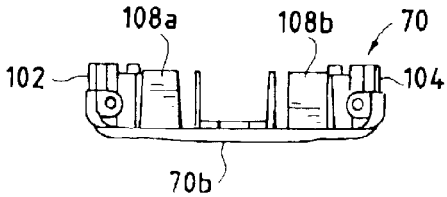
FIG. 11 is an end view, on an enlarged scale, taken substantially along line 11—11 of FIG. 10.

In similar fashion to the upper frame member 68, the lower frame member 70 also has a mildly curved convex lower surface 70*b* which terminates at its forward end in a convex edge surface 70*c* similar to the convex edge surface 68*c* of the upper frame member. Similarly, the forward edge surface 70*c* on the lower frame member establishes concave laterally spaced edge surfaces 70*d* that are mirror images of the concave curved surfaces 68*d* on the upper frame member. Referring to FIGS. 10 and 11, a pair of generally L-shaped walls 108*a* and 108*b* are formed on the rearward end of the lower frame member 70 and cooperate with components of the integral charging system 80 to assist in providing a generally rectangular shaped closed recess within the rear end of the flashlight to receive the modular self-storing blade assembly 88, as will be described.

Figure 12:
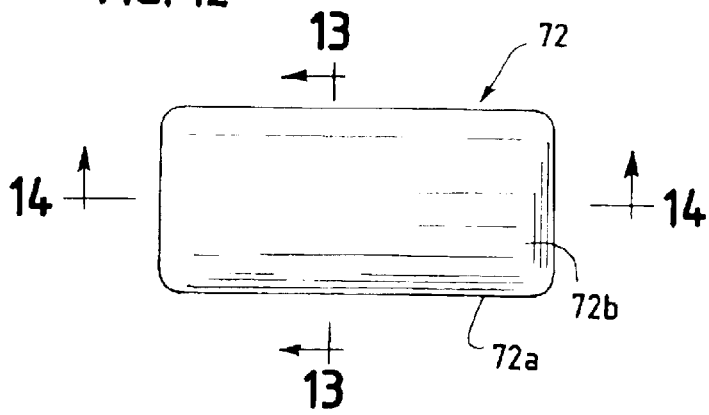
FIG. 12 is a plan view of a representative panel used in conjunction with the top and bottom frame members to form the housing for the flashlight of FIG. 1.
Figure 13:
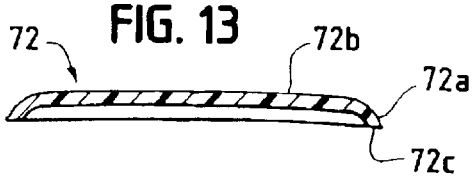
FIG. 13 is a transverse sectional view, on an enlarged scale, taken substantially along line 13—13 of FIG. 12.
Figure 14:
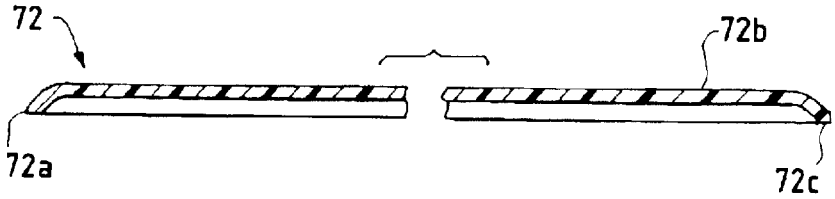
FIG. 14 is a foreshortened longitudinal sectional view, on an enlarged scale, taken substantially along line 14—14 of FIG. 12.

FIGS. 12–14 illustrate a panel member that is representative of both panel members 72 and 74. For purposes of illustration, the panel member illustrated in FIGS. 12–14 will be referred to as the upper panel member 72. The panel member 72 is generally rectangular and has an outer rectangular marginal edge 72*a* that is sized so as to fit within the rectangular opening 68*a* in the upper frame member 68 with the outer marginal edge of the panel slightly underlying the periphery of the rectangular opening 68*a*. The upper frame member is provided with a lip peripherally of the opening 68*a* that accommodates and cooperates with the outer marginal edge 72*a* of the panel 72 so as to retain the panel within the upper frame 68 without need for an adhesive. The panel 72 has a generally planar rectangular surface area 72*b* that is spaced above the plane of a lower rectangular marginal edge 62*c* of the panel so that the upper surface 72*b* will extend slightly outwardly from the frame member 68 when in assembled relation therewith.

As noted, the panel 74 that is received within and supported within the rectangular opening 70*a* in the lower frame member 70 is of substantially the same configuration as a representative panel illustrated in FIGS. 12–14 except having a longer longitudinal length so as to fit snugly within the rectangular opening 70*a*. The panels 72 and 74, which may alternatively be termed top and bottom covers, are preferably made of anodized aluminum, but may also be made of other suitable rigid metals, rubbers, and plastics. Preferably the side panels are made of anodized 6061 aluminum that provides the desired strength and is easily colored for desired eye appeal or contrasting with the color of the polycarbonate frame members 68 and 70. Anodized aluminum can also be easily engraved or imprinted, silk screened, inked, pad printed, or marked in any known manner.

Figure 9:
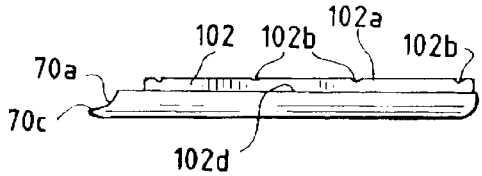
FIG. 9 is a side elevational view of the bottom frame member illustrated in FIG. 8, taken substantially along line 9—9 of FIG. 8.
Figure 15:
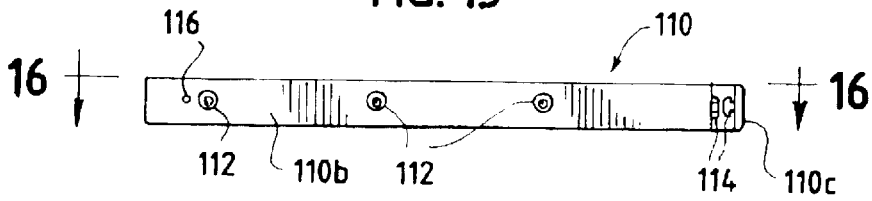
FIG. 15 is an elevational view showing the inner surface of a trim belt representative of a pair of such belts that are attached to opposite sides of the flashlight housing.
Figure 16:
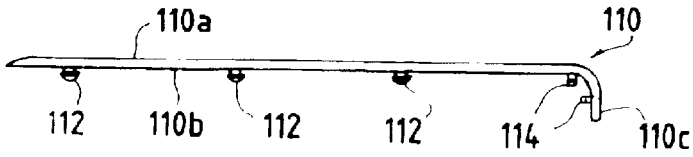
FIG. 16 is an edge view of the belt of FIG. 15, taken substantially along line 16—16 of FIG. 15.

As aforedescribed, when the upper and lower frame members 68 (FIG. 4) and 70 are assembled in mutually overlying relation, circular openings are formed along the laterally spaced sides of the resulting assembly defined by the semi-circular recesses 96*a* and 104*b*, respectively, in the upper and lower frame members, as illustrated in FIGS. 4, 6, and 9. The resulting circular openings or holes facilitate attachment of a pair of elongated trim belts, one of which is indicated at 110 in FIGS. 4, 15, and 16, along the sides 54 and 56 of the flashlight housing 52. The belt 110 is of a transverse width to be received within a longitudinal recess established between longitudinal marginal edge surfaces 96*c* and 102*d*, respectively, formed on the upper and lower frame members 68 and 70 when in assembled relation, as illustrated in FIGS. 4, 6, and 9. The trim belt 110 is preferably made of a resilient material, such as rubber, and has a slightly convex outer surface 110*a* and a generally planar inner surface 110*b* along the longitudinal center axis of which is formed a plurality of spaced headed bosses 112 from the resilient belt material. The bosses 112 are positioned and sized for insertion within the circular openings formed along the sides of the assembled upper and lower frame members 68 and 70. Each of the trim belts 110 has a generally 90° curved end portion 110*c* on the inner surface of which is formed a pair of inwardly directed integral bosses 114 sized to be received within corresponding openings formed in the assembled upper and lower frame members 68 and 70 so as to wrap around curved rear comers of the assembled frame members. A small opening or hole 116 is formed in each of the trim belts 110 at a position to overlie an opening in each depending wall 94 and 96 of the upper frame members 68 and 70, as indicated at 96*d* in FIG. 6 and enable entry of a small diameter rod, such as the straightened end of a paper clip, to facilitate release of the lens 86 from the flashlight housing. The trim belts protect the housing sides from abrasion and also provide a comfortable improved gripping for the flashlight.

Figure 17:
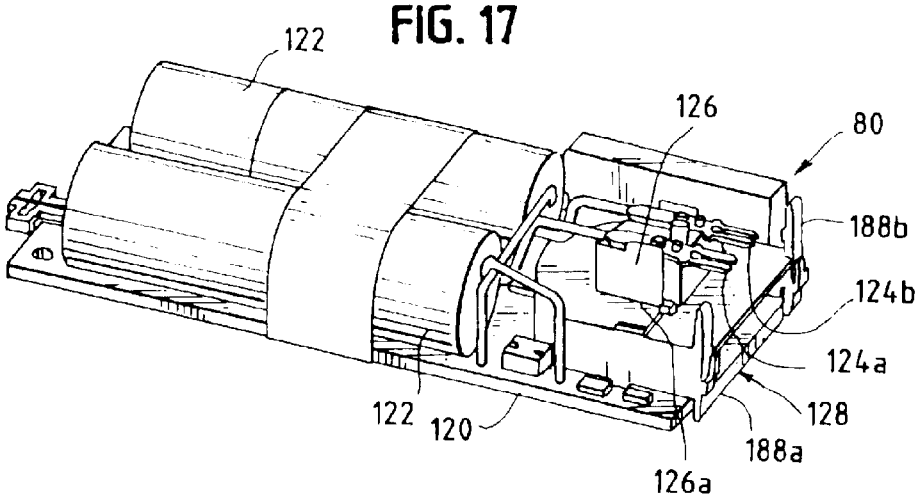
FIG. 17 is a perspective view illustrating the rechargeable battery power supply and associated recharging subassembly along with a battery pack receiving housing as employed in the flashlight of FIG. 1.

Referring to FIG. 17, the integral battery charging system 80 includes a generally rectangular rigid circuit board 120 having a pair of generally rectangular openings 120*a* and 120*b* to receive and cradle a pair of conventional AA size nominal voltage 1.2 V rechargeable batteries 122 preferably of the nickel cadmium type such as available from Panasonic® Corporation as its Model No. P-80AAS/FT, type S. The batteries 122 are connected in circuit to a pair of bifurcated conductive connectors 124*a* and 124*b* that are supported in coplanar parallel spaced relation on a support block or wall 126 formed integral with or otherwise suitably secured to the upper surface of a battery pack receiving housing, indicated generally at 128, to be described.

Figure 2:
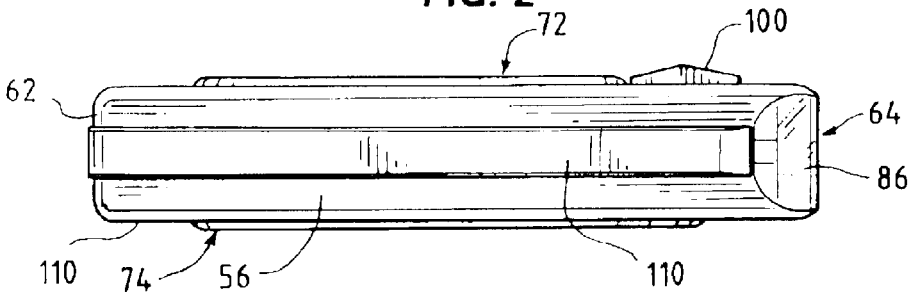
FIG. 2 is a side elevational view of the flashlight of FIG. 1.
Figure 3A:
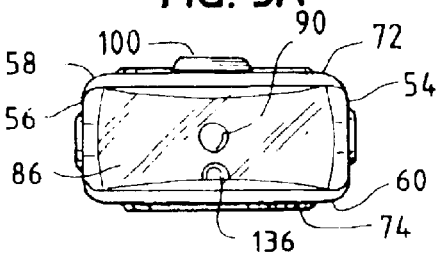
FIG. 3A is an elevational view, on an enlarged scale, of the front lens end of the flashlight of FIG. 1.
Figure 18:
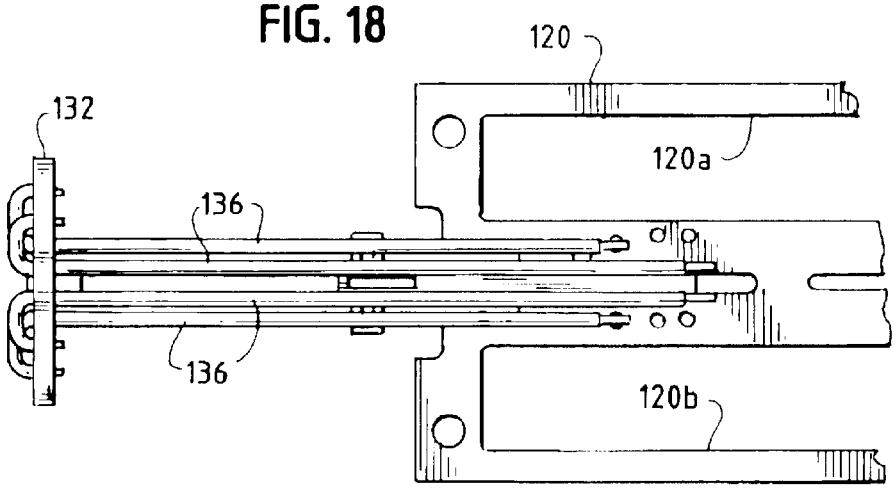
FIG. 18 is a view of the subassembly of FIG. 17 but showing the bulb holder connected to the circuit board on which the batteries, recharging circuit and battery pack receiving housing are supported.
Figure 19:
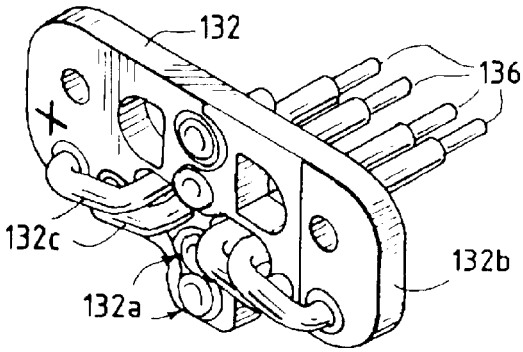
FIG. 19 is a perspective view, on an enlarged scale, of the bulb holder shown in FIG. 18.
Figure 20:
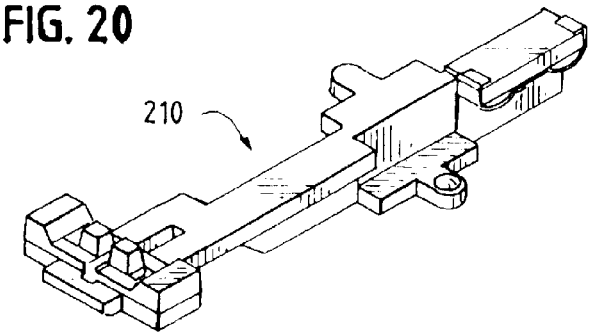
FIG. 20 is a perspective view of the switch actuator that is mounted on the circuit board.
Figure 21:
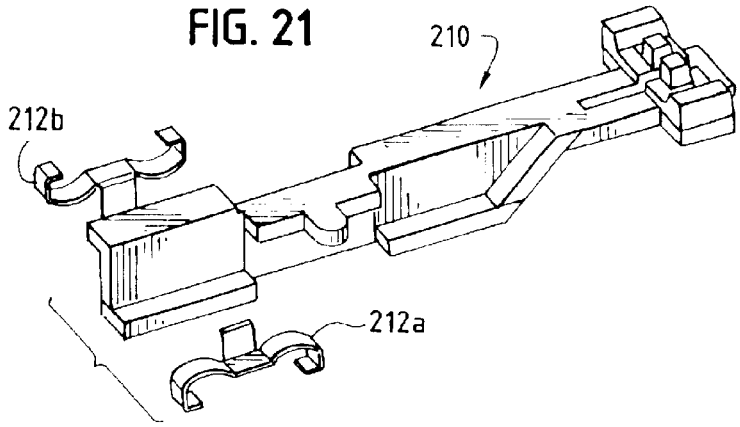
FIG. 21 is a perspective view of the switch actuator shown in FIG. 20 but from a different perspective and showing sliding contacts that are carried by the actuator.
Figure 22:
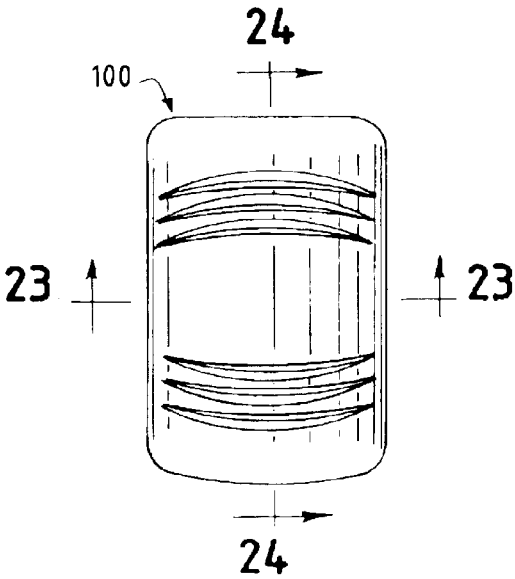
FIG. 22 is a plan view of the switch button mounted on the flashlight frame and cooperative with the switch actuator of FIGS. 20 and 21 to enable actuation of the dual modes of the flashlight.
Figure 23:
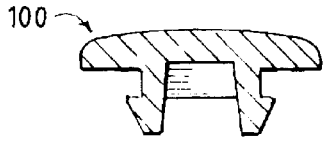
FIG. 23 is a transverse sectional of the switch button taken substantially along line 23—23 of the FIG. 22.
Figure 24:
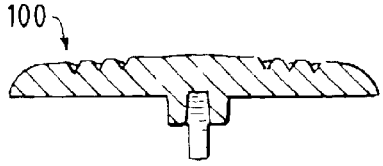
FIG. 24 is a longitudinal sectional of the switch button of FIG. 22, taken substantially along line 24—24 of FIG. 22.

Referring to FIGS. 18 and 19, a bulb holder 132 is adapted to be mounted on the reflector and light source assembly 84 and enables support of a high luminous intensity dual pin LED, such as indicated at 136 in FIGS. 3 and 4, so that the axis of the LED lies below the longitudinal axis of the flashlight when considered in a generally horizontal orientation as in FIGS. 2 and 3. To this end, the bulb holder 132 has a pair of vertically aligned LED receptacles 132*a* adapted to support the dual pin LED so as to extend forwardly from a forward surface 132*b* of the bulb holder. In the preferred embodiment, the LED light source is an "E" grade LED or lensed "D" grade LED. Such a high intensity LED may be obtained from Hiyoshi Electric, Co., Ltd. located in Tokyo, Japan, having Part No. E1L53-3BL. The preferred high intensity LED emits white light.

The bulb holder 132 also has a pair of receptacles 132*c* adapted to receive the conductor pins of the dual pin high intensity bulb or lamp 90 that preferably comprises a dual pin Xenon lamp so that the longitudinal axis of lamp 90 lies substantially on the major longitudinal axis of the flashlight and the longitudinal axes of the lamp 90 and LED 136 lie in a plane containing the longitudinal axis of the flashlight and normal to the generally parallel upper and lower surfaces of the flashlight housing. The bulb holder 132 has suitable conductors formed on its opposite surfaces to connect the leads of the LED 136 and lamp 90 to suitable insulated conductor wires, some of which are indicated at 137, that have their ends opposite the bulb holder connected to the circuit board 110 in discrete separate circuits to a switch assembly operative to connect the LED and lamp to their respective power sources.

Figure 25:
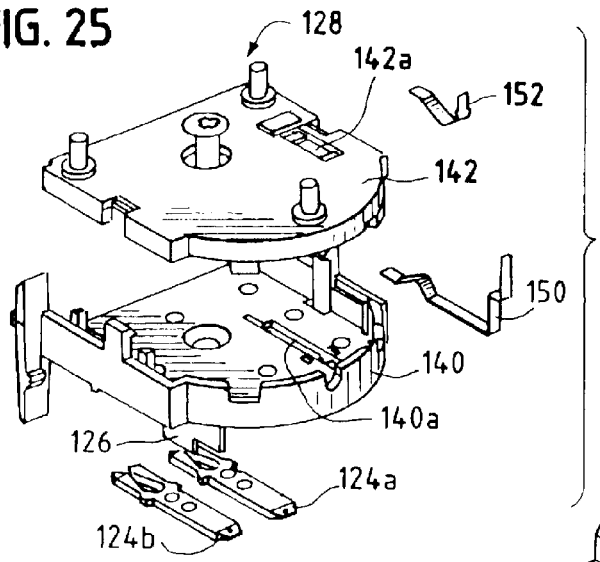
FIGS. 25–27 are perspective views of the replaceable battery pack receiving housing employed in the subassembly of FIG. 17.
Figure 26:
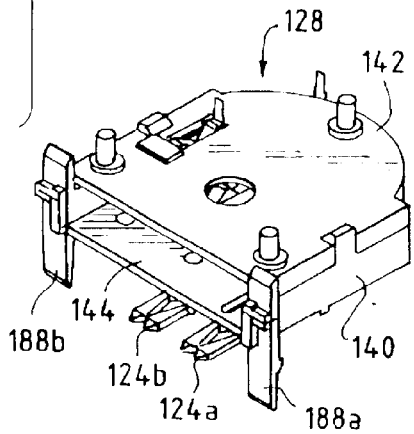
Figure 27:
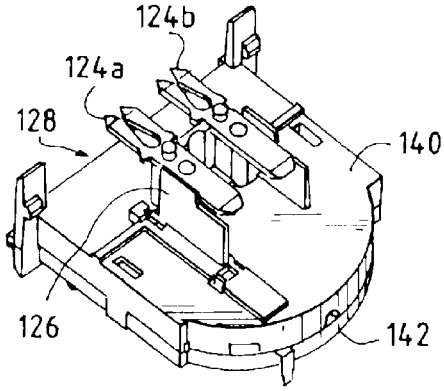

Referring now to FIGS. 25–27, the battery pack receiving housing 128 is preferably formed of a suitable plastic material, such as polycarbonate, and may be formed with mutually cooperable upper and lower housing portions 140 and 142 adapted to be inter-fitted or assembled so as to establish a modular power pack receiving chamber 144 having a generally rectangular open entrance to enable insertion of a modular power pack 82. The upper and lower portions 140 and 142 of the battery pack receiving housing have rectangular openings 140*a* and 142*a*, respectively, sized to receive electrically conductive contacts as indicated at 150 and 152, respectively. The contacts 150 and 152 are configured to engage exposed terminals of a pair of 3-volt circular batteries housed within the modular battery pack 82 as through openings 82*a* and 82*b*, respectively, formed in opposite sides of the battery pack as illustrated in FIGS. 28 and 29.

As best seen in FIG. 27, the bifurcated connectors 124*a* and 124*b* are supported on the housing portion 140 of the power pack receiving housing 128 through the generally U-shaped wall or block 126 so that the bifurcated connectors lie in a common plane parallel to the exposed surface of the housing portion 140. The generally U-shaped support wall 126 has a pair of slots 126*a* formed on the opposite sides thereof such that the slots are disposed generally normal to the exposed surface of housing member as illustrated in FIG. 17. The slots 126*a* are configured to receive the free edges of the L-shaped walls 108*a* and 108*b* on the lower housing frame member 70 when the frame members 68 and 70 and the associated panels 72 and 74 are in assembled relation with the battery charging system 80 disposed internally of the flashlight housing. In this manner, the exposed surface of the power pack receiving housing portion 140, the outwardly exposed surfaces of the L-shaped walls 108*a* and 108*b* and an adjacent surface portion of the panel 74 and associated frame member 70 establish a generally closed cavity in which the rearwardly directed bifurcated ends of the contacts 124*a* and 124*b* are exposed.

Figure 28:
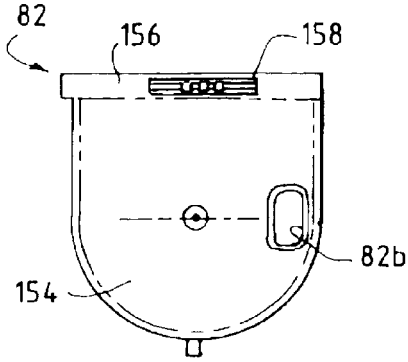
FIGS. 28 and 29 illustrate opposite sides of a battery pack adapted for removable insertion within the battery pack receiving housing of FIGS. 25–27.
Figure 29:
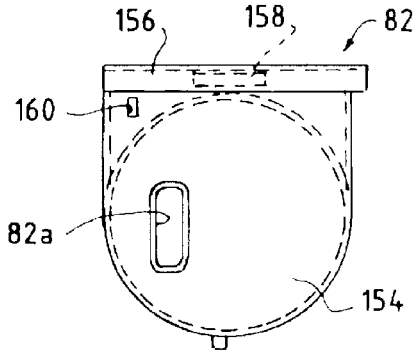

The battery power pack is illustrated in FIGS. 28 and 29 is described in detail in co-pending application, Ser. No. 10/066,554, filed Jan. 31, 2002, by the inventors of the subject invention and is incorporated herein by reference. In the illustrated embodiment, the modular power pack 82 includes a generally hollow housing 154 having parallel sides establishing a width sufficient to receive a pair of 3-volt lithium coin cell batteries as available from Panasonic® bearing the CR2016 marking and that provide exceptionally long life and durability and operate at low temperatures and are leak proof and vibration resistant. The power pack housing 154 has a transverse flange portion 156 that extends laterally outwardly from one of the side edges of the housing so as to require a predetermined orientation when inserting the power pack housing within the recess 144 of the battery pack receiving housing 128, it being understood that a suitably positioned notch is provided adjacent the opening to the receiving chamber 144 to enable registration with the extended end portion of the battery pack housing 154. A nail slot or notch 158 is formed in the flange portion 156 of the battery holder to facilitate removal of the battery pack from the housing 128. An opening 160 is also formed in the power pack housing 154 opposite the side in which the nail slot 158 is formed so as to facilitate entry of a small rod-like member, such as paperclip, to assist in removing the power pack from the support housing 128.

Figure 30:
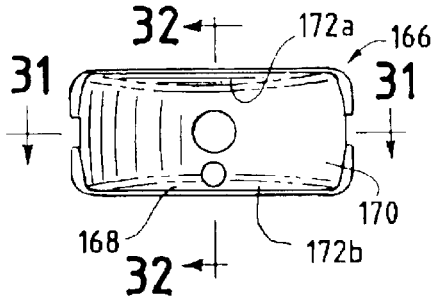
FIG. 30 is a front elevational view of the lamp reflector member shown in FIG. 4.
Figure 31:
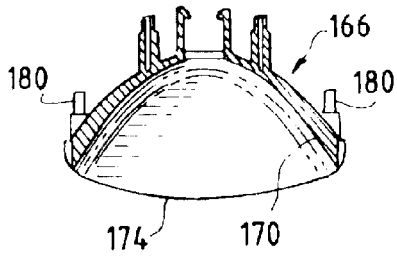
FIG. 31 is a sectional view of the reflector of FIG. 30 taken substantially along line 31—31 of FIG. 30.
Figure 32:
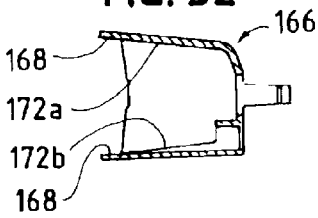
FIG. 32 is a sectional view of the reflector of FIG. 30 taken substantially along line 32—32 of FIG. 30.
Figure 33:
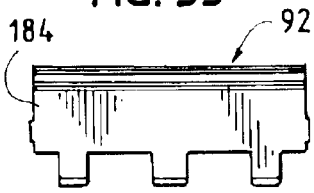
FIGS. 33–36 illustrate the access door that is pivotally mounted on the rear end of the flashlight of FIG. 1 and enables access to the battery pack receiving housing.
Figure 34:
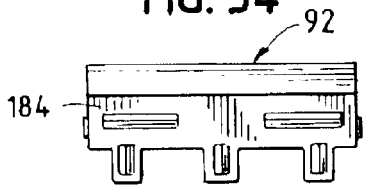
Figure 36:
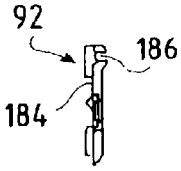
Figure 35:
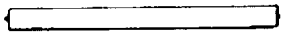

Referring now to FIGS. 30–32, the parabolic reflector of the parabolic reflector and light source assembly 84 is indicated at 166 and has a generally rectangular outer opening 168, when considered in front elevation as in FIG. 30, formed forwardly of a parabolic shaped reflective surface 70. Upper and lower reflective surfaces 172*a* and 172*b* complete the reflector surfaces and define generally outwardly convex edge surfaces for the reflector, as indicated at 174 in FIG. 31.

The reflector 166 has a pair of vertically aligned openings 176 and 178 that enable the high intensity bulb 90 and LED 136 to be inserted into the parabolic reflector area of the reflector 166 when the bulb holder 132 is brought into abutting relation with the rear portion of the reflector. The reflector 166 has four corner bosses, two of which are indicated at 180 in FIG. 31, that facilitate attachment of the parabolic reflector to the flashlight housing internally of the forward end thereof. When thus installed, the wrap around lens 86 may be secured forwardly of the parabolic reflector and light source assembly 84. To this end, the lens 86 has a pair of laterally spaced arms 86*a* and 86*b* that are adapted to be inserted internally of the assembled frame members 68 and 70 and retained therein by detent ends on the arms 86*a* and 86*b* snapping rearwardly of the rear edges of forward wall portions 96*e* formed on the upper frame member 68 as illustrated in FIGS. 4 and 6. As aforedescribed, insertion of a paperclip-like rod through the openings 116 in the trim belts 110 effects release of the detents and arms 86*a,b* of the lens from the flashlight housing to provide access to the reflector and light source assembly 84.

FIGS. 33–37 illustrate the access door 92 that is pivotally mounted on the rear end of the flashlight housing 52 to provide access to a power pack within the power pack support housing 128 for replacement. The access door is generally formed of a suitable plastic such as polycarbonate and is formed with a hinge pin receiving slot 186 adapted to couple with a hinge rod (not shown) the opposite ends of which can be retained within hinge rod support members 188*a* and 188*b* fixed to power pack receiving housing 128 adjacent the laterally opposite sides of the access opening 144 as shown in FIGS. 17 and 26. The access door 184 is sized to cover the access opening 144 to the modular power pack support housing 128 and enables a corresponding length of trim belt 110', sized to correspond to the aforedescribed trim belts 110, to be secured to the outer surface of the access door so as to establish a visual continuous length of trim belt about the sides and rear end of the flashlight housing.

Figure 3B:
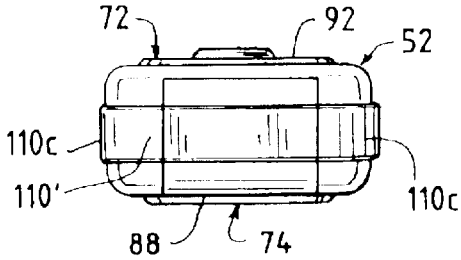
FIG. 3B is an elevational view of the rear battery pack access end of the flashlight of FIG. 1.
Figure 37:
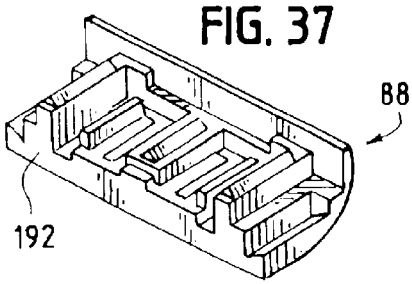
FIGS. 37 and 38 are perspective views illustrating components of a modular self-storing contact holder adapted for releasable mounted on the rear end of the flashlight of FIG. 1 and operative to enable connection to an electrical outlet for recharging the batteries illustrated in FIG. 17.
Figure 38:
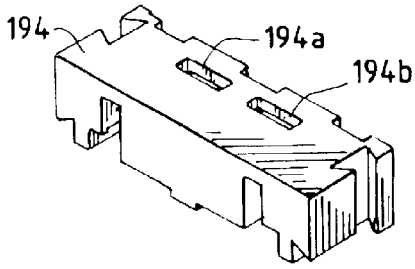
Figure 39:
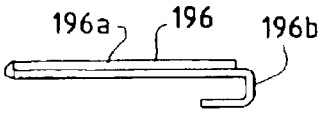
FIGS. 39 and 40 illustrate a typical contact of the pair of contacts supported by the self-storing contact support module of FIGS. 37 and 38.
Figure 40:
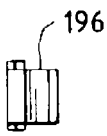

Referring to FIGS. 37–39, taken in conjunction with FIG. 4, the modular self-storing blade assembly 88 includes a pair of blade support blocks 192 and 194 that are cooperative receive and support a pair of blade contacts 196 one of which is illustrated in FIGS. 39 and 40. When in assembled relation, the blade support blocks 192 and 194 support a pair of the blade contacts 196 so that lengths of the contacts extend outwardly from the resulting blade assembly, as indicated at 196*a* and 196*b* in FIG. 4, with generally U-shaped ends 196*b* of the contacts being captured within the blade assembly 88 and accessible through openings 194*a* and 194*b* in the blade support block 194. The modular blade assembly 88 is sized to be inserted into the aforedescribed receiving chamber peripherally of the exposed contacts 124*a* and 124*b* such that the contacts 196*a* and 196*b* enter the bifurcated contacts and are frictionally retained therein. The outer surface of the blade support block 192 is contoured so as to blend with the curved edge surfaces of the lower frame member 70 at its rearward end to provide a smooth external surface as illustrated in FIGS. 2 and 3B. When it is necessary to charge the batteries 122, the blade assembly 188 is removed from the flashlight housing and rotated 900 and reinserted with the slots 194*a* and 194*b* oriented to receive the bifurcated contacts 124*a,b*. In this manner, the contacts 196*a,b* may be plugged into an electrical outlet to recharge the batteries 122.

Figure 41:
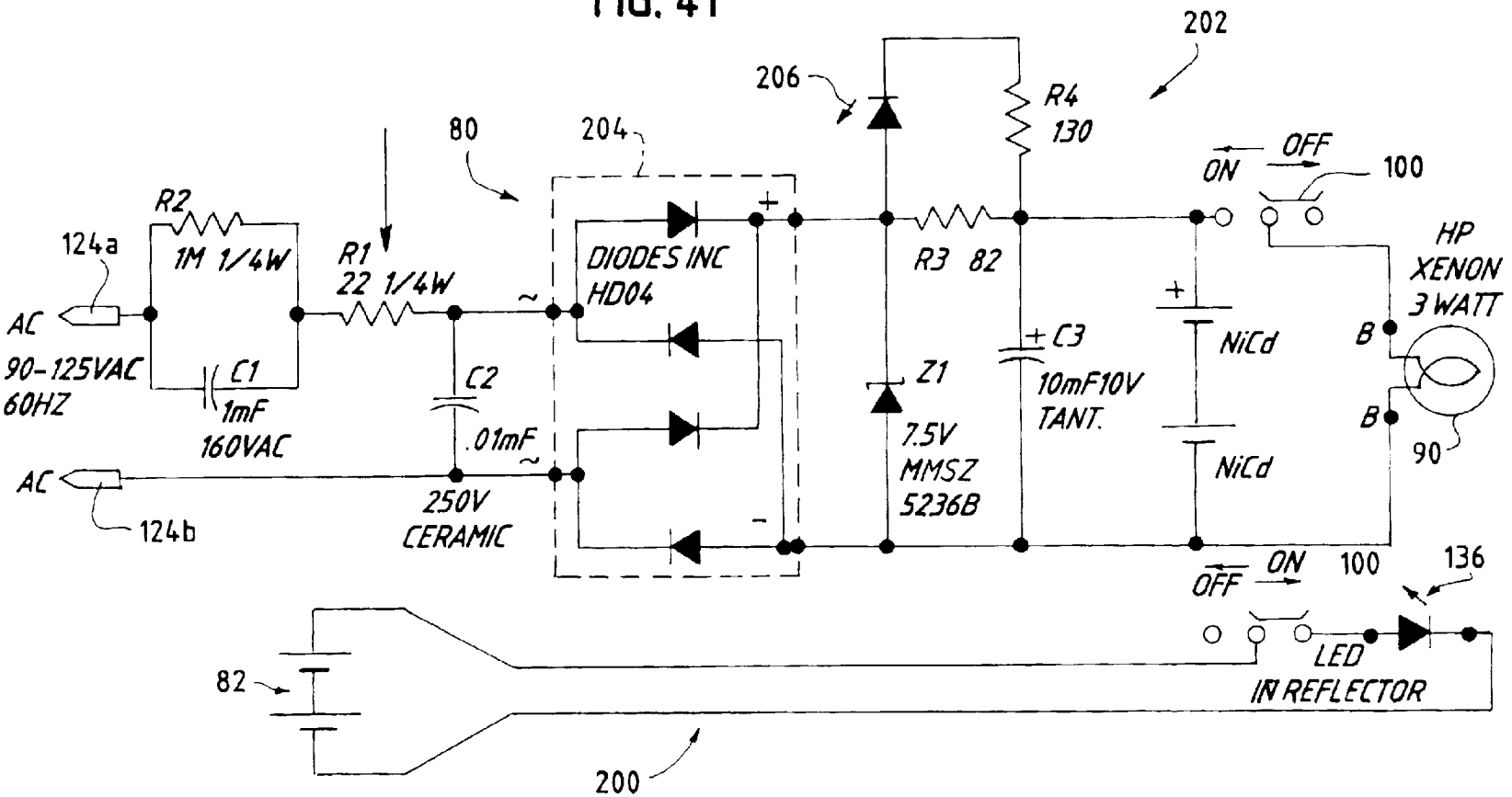
FIG. 41 illustrates circuit diagrams employed in the flashlight of FIG. 1 for selectively energizing the high intensity lamp and LED employed in the flashlight.

FIG. 41 illustrates a pair of circuits, indicated generally at 200 and 202 which represent discrete control circuits, respectively, enabling connection of the LED 136 to a modular battery 82 disposed within the battery pack support housing 128, and connection of the rechargeable power supply 80 to the high intensity lamp 90.

Circuit 202 includes the battery charging system 80 that includes a rectifier 204 and is operative in response to selective positioning of the switch 100, which, as shown in FIG. 41, is a two gang double role double throw switch, to connect the Xenon lamp 90 to the battery charging system 80. The circuit 202 is auto sensitive for 120 AC or 220 AC input to the DC rechargeable batteries 122. Circuit 202 includes an LED indicator 206 that is visible through an opening at the rear of the upper frame member 68, as indicated at 208 in FIG. 5, to indicate when the batteries 112 are being charged.

Referring now to FIGS. 20–24 the switch button or knob 100 is adapted to be slidably received within the rectangular opening 98 in the upper frame member 68 for sliding in the horizontal direction of the flashlight. The switch button 100 cooperates with a switch actuator, indicated generally at 210 in FIGS. 20 and 21, that is slidably supported on the circuit board 120 and carries contacts 212*a* and 212*b* operative in response to movement of the switch 100 in a forward position to energize the Xenon lamp 90, and operative in a rear position of the switch button to connect the LED 136 to its associated power pack 82.

Thus, in accordance with the present invention, a very compact small size flashlight has been provided that enables aesthetic presentation through different colored panels 72 and 74 relative to the color of the associated housing frame members 68 and 70 and which enables operation of a high intensity brilliant Xenon lamp upon predetermined forward movement of switch button 100. Rearward actuation of the switch button 100 is operative to energize the high intensity long life LED so that the LED mode may be initiated should the batteries 122 of the integral battery charging system 80 become discharged. Moreover, energizing the LED provides a high intensity signal that can be visually seen from approximately one mile away and has its light rays visible through the lens 86 so that the flashlight can be observed from a position disposed at approximately 90° to the axis of the flashlight, thus providing significant safety features in the event one is lost.

While a preferred embodiment of the invention has been illustrated and described, it will be understood that changes and modifications may be made therein without departing from the invention in its broader aspects. Various features of the defined in the following claims.

What is claimed is:

1. A flashlight, comprising, in combination:

a flashlight housing having a forward light emitting end and a rear end;

a reflector and light source assembly supported within the forward end of said flashlight housing;

a high intensity light source supported within said reflector and light source assembly so as to lie generally on a longitudinal axis of said flashlight housing;

an LED light source supported within said reflector and light source assembly;

a first circuit within said flashlight housing operative to interconnect said high intensity light source to a rechargeable battery within said flashlight housing for providing power to said high intensity light source and enabling recharging of said battery;

a second discrete circuit within said flashlight housing interconnecting said LED to a power source independent of said rechargeable battery in said first circuit; and switch means carried by said flashlight housing for selective movement between a first position operative to energize said high intensity light source from said rechargeable battery in said first circuit, and operative in a second position to energize said LED from its power source in said second circuit.

2. The flashlight as defined in claim 1 wherein the rechargeable battery is a nickel cadmium or lithium type of battery.

3. The flashlight as defined in claim 1 wherein the power source independent of said first circuit is a lithium or alkaline type of battery.

4. A flashlight as defined in claim 1 including means facilitating connection of said flashlight to an electrical receptacle for recharging said said rechargeable battery in said first circuit without removing said batteries from the flashlight housing.

5. The flashlight as defined in claim 1 wherein said LED is supported by said reflector and light source assembly in close proximity to said high intensity light source.

6. The flashlight as defined in claim 5 wherein said reflector defines a parabolic reflector surface.

7. The flashlight as defined in claim 1 including a lens mounted forwardly of said reflector and light source assembly and having a convex external surface operative to effect dispersion of light rays from said high intensity light source or said LED.

8. The flashlight as defined in claim 7 wherein said high intensity light source and said LED have longitudinal axes lying in a plane containing a longitudinal axis of said flashlight housing.

9. The flashlight as defined in claim 1 wherein said flashlight housing is generally rectangular.

10. The flashlight as defined in claim 1 including a modular adaptor adapted for self-storage within the flashlight housing and adapted to be removed and rotated to a position exposing electrical contacts for connection to an electrical outlet.

11. The flashlight as defined in claim 1 wherein the first circuit is configured to be operatively coupled to a source of AC power to facilitate charging of said rechargeable battery.

12. The flashlight as defined in claim 11 wherein the first circuit further includes a full wave rectifier circuit.

13. The flashlight of claim 1 wherein said high intensity light source includes a Xenon lamp.

14. A flashlight, comprising, in combination:

a flashlight housing having a forward light emitting end and a rear end;

a reflector and light source assembly supported within the forward end of said flashlight housing;

a high intensity light source supported within said reflector and light source assembly so as to lie generally on a longitudinal axis of said flashlight housing;

an LED light source supported within said reflector and light source assembly;

a first circuit within said flashlight housing operative to interconnect said high intensity light source to a rechargeable battery within said flashlight housing for providing power to said high intensity light source and enabling recharging of said battery;

a second discrete circuit within said flashlight housing interconnecting said LED to a power source independent of said rechargeable battery in said first circuit;

switch means carried by said flashlight housing for selective movement between a first position operative to energize said high intensity light source through said first circuit, and operative in a second position to energize said LED from its power source, and said housing is generally rectangular and is defined by a pair of generally rectangular frame members and a pair of panels cooperative with the frame members to define opposite sides of said rectangular housing.

15. The flashlight as defined in claim 14 wherein said panels are made of a different material from the material of the frame members.

16. The flashlight as defined claim 15 wherein said panels are of a color different from the color of said frame members.

17. The flashlight as defined in claim 16 wherein said panel members are adapted to have indicia imprinted thereon.

18. The flashlight as defined in claim 14 wherein said panels are made of aluminum.

19. A flashlight, comprising, in combination:

a flashlight housing having a forward light emitting end and a rear end;

a reflector and light source assembly supported within the forward end of said flashlight housing;

a high intensity light source supported within said reflector and light source assembly so as to lie generally on a longitudinal axis of said flashlight housing;

an LED light source supported within said reflector and light source assembly;

a first circuit within said flashlight housing operative to interconnect said high intensity light source to a rechargeable battery within said flashlight housing for providing power to said high intensity light source and enabling recharging of said battery;

a second discrete circuit within said flashlight housing interconnecting said LED to a power source independent of said rechargeable battery in said first circuit;

switch means carried by said flashlight housing for selective movement between a first position operative to energize said high intensity light source through said first circuit, and operative in a second position to energize said LED from its power source and a modular adaptor adapted for self-storage within the flashlight housing and adapted to be removed and rotated to a position exposing electrical contacts for connection to an electrical outlet and said adaptor module being retained within said flashlight housing by a pair of bifurcated contacts, said housing being operative to frictionally engage said contacts.

20. A flashlight, comprising, in combination:

a flashlight housing having a forward light emitting end and a rear end;

a reflector and light source assembly supported within the forward end of said flashlight housing;

a high intensity light source supported within said reflector and light source assembly so as to lie generally on a longitudinal axis of said flashlight housing;

an LED light source supported within said reflector and light source assembly;

a first circuit within said flashlight housing operative to interconnect said high intensity light source to a rechargeable battery within said flashlight housing for providing power to said high intensity light source and enabling recharging of said battery;

a second discrete circuit within said flashlight housing interconnecting said LED to a power source independent of said rechargeable battery in said first circuit; and switch means carried by said flashlight housing for selective movement between a first position operative to energize said high intensity light source through said first circuit, and operative in a second position to energize said LED from its power source said first circuit beings configured to be operatively coupled to a source of AC power to facilitate charging of said rechargeable battery and including circuitry for automatically senses application of either 120 volts AC or 220 volts AC to facilitate the proper charging of the rechargeable batteries.

21. A rechargeable flashlight comprising, in combination, a flashlight housing having a forward light emitting end and a rear end, a light source assembly disposed within said light emitting end of said housing;

said light source assembly including a high intensity light source;

a first circuit within said flashlight housing including a rechargeable power source and means for interconnecting said high intensity light source to said rechargeable power source;

said light source assembly further including a light emitting diode;

a second circuit within said flashlight housing independent of said first circuit and including a power source, separate from said rechargeable vower source in said first circuit adapted to be connected in circuit to said light emitting diode; and a switch operative in a first position to energize said high intensity light source, and operative in a second position to energize said light emitting diode.

22. The flashlight as defined in claim 21 including an integral battery charging system disposed within said flashlight housing operative to facilitate connection of said charging system to an electrical outlet.

23. The flashlight as defined in claim 22 wherein the integral battery charging system further includes a full wave rectifier circuit.

24. The flashlight as defined in claim 21 wherein the first circuit is configured to be operatively coupled to a source of AC power to facilitate charging of said rechargeable battery.

25. The flashlight as defined in claim 21 including a modular blade adaptor carried within said flashlight housing and removable to interconnect a battery charging system for said rechargeable power source to an electrical power outlet.

26. The flashlight as defined in claim 25 wherein said modular blade adaptor includes a self-storing blade assembly selected from a blade assembly adapted for insertion into a conventional United States style electrical blade receptacle, and an adaptor different receptacles for enabling recharging with receptacles used in many countries outside the United States.

27. The flashlight of claim 21 wherein said high intensity light source includes a Xenon lamp.

28. A rechargeable flashlight comprising, in combination, a flashlight housing having a forward light emitting end and a rear end, a light source assembly disposed within said light emitting end of said housing:

said light source assembly including a high intensity light source;

a first circuit within said flashlight housing including a rechargeable power source and means for interconnecting said high intensity light source to said rechargeable power source;

said light source assembly further including a light emitting diode;

a second circuit within said flashlight housing independent of said first circuit and including a power source, separate from said rechargeable power source in said first circuit adapted to be connected in circuit to said light emitting diode;

a switch operative in a first position to energize said high intensity light source, and operative in a second position to energize said light emitting diode and said power source for said light emitting diode including a modular replaceable battery pack adapted to be connected in circuit with said light emitting diode.

29. A rechargeable flashlight comprising, in combination, a flashlight housing having a forward light emitting end and a rear end, a light source assembly disposed within said light emitting end of said housing:

said light source assembly including a high intensity light source;

a first circuit within said flashlight housing including a rechargeable power source and means for interconnecting said high intensity light source to said rechargeable power source;

said light source assembly further including a light emitting diode;

a second circuit within said flashlight housing independent of said first circuit and including a power source, separate from said rechargeable power source in said first circuit adapted to be connected in circuit to said light emitting diode;

a switch operative in a first position to energize said high intensity light source, and operative in a second position to energize said light emitting diode and an integral battery charging system disposed within said flashlight housing operative to facilitate connection of said charging system to an electrical outlet and the integral battery charging system senses application of either 120 volts AC or 220 volts AC to facilitate the proper charging of the rechargeable batteries.

30. A flashlight comprising, in combination:

a generally rectangular hand-holdable housing having laterally spaced generally parallel longitudinal side surfaces, generally parallel upper and lower surfaces, a rear end surface and a forward lens end, said lens end being defined by a concave reflector opening outwardly of said housing and a lens disposed to cover said reflector opening so as to extend around forward ends of said side walls to enable light rays to pass forwardly from said lens and angled outwardly from a longitudinal axis of said housing;

a first high intensity light source mounted within said lens end rearwardly of said lens;

a second low intensity LED light source within said lens end rearwardly of the lens and having a longitudinal axis disposed substantially parallel to and spaced from said first light source, a rechargeable power source mounted within said housing, a first electrical circuit disposed within said housing and cooperable with said rechargeable power source and first light source so as to connect said first high intensity light source in circuit with said rechargeable power source in response to a first predetermined actuation of a switch actuator accessible from externally of said housing;

a replaceable power source, separate from said rechargeable power source, supported within said housing; and a second electrical circuit disposed within said housing and cooperable with said replaceable power source and said LED light source so as to connect said LED light source to said replaceable power source while simultaneously disconnecting said first high intensity light source from said rechargeable power source in response to a second predetermined actuation of said switch actuator.

31. A flashlight, comprising, in combination:

a flashlight housing having a forward light emitting end and a rear end;

a generally parabolic reflector and light source assembly supported within the forward end of said flashlight housing;

a high intensity light source supported within said reflector and light source assembly so as to lie generally on a longitudinal central axis of said flashlight housing;

an LED light source supported within said reflector and light source assembly so as to lie generally on a longitudinal axis of said flashlight housing offset from, but parallel to, said longitudinal central axis;

a first circuit within said flashlight housing operative to interconnect said high intensity light source to a rechargeable battery within said flashlight housing for providing power to said high intensity light source and for enabling recharging of said battery;

a second discrete circuit within said flashlight housing interconnecting said LED to a power source independent of said rechargeable battery in said first circuit;

a first switch carried by said flashlight housing operative to energize said high intensity light source through said first circuit; and a second switch carried by said flashlight housing operative to energize said LED from its power source in said second circuit.

32. The flashlight as defined in claim 31 wherein the first and second switches are configured as a two gang, double pole, double throw switch having selective movement between a first position operative to energize said high intensity light source and simultaneously de-energize said LED, and operative in a second position to energize said LED from its power source and simultaneously de-energize said high intensity light source.

33. The flashlight of claim 31 wherein said reflector and light source assembly is covered by a forwardly positioned, convexly curved, wrap around lens that has two rearwardly extending arms for fixing the lens to the flashlight housing.

34. The flashlight of claim 31 wherein said high intensity light source includes a Xenon lamp.

35. A flashlight comprising, in combination, a flashlight housing having a forward light emitting end and a rear end, a light source assembly disposed within said light emitting end of said housing;

said light source assembly including a first light source having a first intensity;

a first circuit within said flashlight housing including means for interconnecting said first light source to a first type of power source;

said light source assembly further including a second light source independent of said first light source and having a second intensity different than said first light intensity;

a second circuit within said flashlight housing independent of said first circuit and including a second type of power source, separate from said first type of power source, adapted to be connected in circuit to said second light source; and a switch operative in a first position to energize said first light source, and operative in a second position to energize said second light source.

36. The flashlight as defined in claim 35 wherein the first type of power source is a rechargeable battery.

37. The flashlight as defined in claim 35 wherein the second type of power source is a disc type non-rechargeable battery.

38. The flashlight of claim 35 wherein said first light source includes a Xenon lamp.

39. The flashlight of claim 35 wherein said second light source includes an LED.

40. A flashlight comprising, in combination, a flashlight housing having a forward light emitting end and a rear end, a light source assembly disposed within said light emitting end of said housing;

said light source assembly including a first light source;

a first circuit within said flashlight housing including means for interconnecting said first light source to a first type of power source;

said light source assembly further including a second light source;

a second circuit within said flashlight housing independent of said first circuit and including a second type of power source, separate from said first type of power source, adapted to be connected in circuit to said second light source; and a switch operative in a first position to energize said first light source, and operative in a second position to energize said second light source and said first type of power source providing an output voltage substantially different than an output voltage of the second type of power source.

41. A flashlight, comprising, in combination:

a flashlight housing having a forward light emitting end and a rear end;

a reflector and light source assembly supported within the forward end of said flashlight housing;

a high intensity light source supported within said reflector and light source assembly so as to lie generally on a longitudinal axis of said flashlight housing;

an LED light source supported within said reflector and light source assembly;

a first circuit within said flashlight housing operative to interconnect said high intensity light source to a rechargeable battery within said flashlight housing for providing power to said high intensity light source and enabling recharging of said battery;

a second discrete circuit within said flashlight housing interconnecting said LED to a power source independent of said rechargeable battery in said first circuit;

a first switch carried by said flashlight housing operative to energize said high intensity light source through said first circuit; and a second switch carried by said flashlight housing operative to energize said LED light source through said second circuit.

42. The flashlight of claim 41 wherein said high intensity light source includes a Xenon lamp.

43. A flashlight comprising, in combination, a flashlight housing having a forward light emitting end and a rear end, a light source assembly disposed within said light emitting end of said housing;

said light source assembly including a first light source;

a first circuit within said flashlight housing including means for interconnecting said first light source to a first type of power source;

said light source assembly further including a second light source;

a second circuit within said flashlight housing independent of said first circuit and including a second type of power source, separate from said first type of power source, adapted to be connected in circuit to said second light source;

a switch operative in a first position to energize said first light source, and operative in a second position to energize said second light source;

and said housing is generally rectangular and is defined by a pair of generally rectangular frame members and a pair of panels cooperative with the frame members to define opposite sides of said rectangular housing.

44. The flashlight as defined in claim 46 wherein said panels are made of a different material from the material of the frame members.

45. The flashlight as defined in claim 46 wherein said panels are made of aluminum.

46. The flashlight as defined in claim 43 wherein said panels are adapted to have indicia imprinted thereon.

47. A flashlight comprising, in combination, a flashlight housing having a forward light emitting end and a rear end, a light source assembly disposed within said light emitting end of said housing;

said light source assembly including a first light source;

a first circuit within said flashlight housing including means for interconnecting said first light source to a first type of power source;

said light source assembly further including a second light source;

a second circuit within said flashlight housing independent of said first circuit and including a second type of power source, separate from said first type of power source, adapted to be connected in circuit to said second light source;

a switch operative in a first position to energize said first light source, and operative in a second position to energize said second light source; and a modular blade adaptor adapted for self-storage within the flashlight housing and adapted to be removed and rotated 90 degrees to a position exposing electrical blade contacts for connection to an electrical outlet.

48. A flashlight comprising, in combination, a flashlight housing having a forward light emitting end and a rear end, a light source assembly disposed within said light emitting end of said housing;

said light source assembly including a first, Xenon lamp, light source;

a first circuit within said flashlight housing including means for interconnecting said first light source to a first type of power source;

said light source assembly further including a second, LED lamp, light source;

a second circuit within said flashlight housing independent of said first circuit and including a second type of power source, separate from said first type of power source, adapted to be connected in circuit to said second light source; and a switch operative in a first position to energize said first light source, and operative in a second position to energize said second light source.

49. A flashlight comprising, in combination, a flashlight housing having a forward light emitting end and a rear end, a light source assembly disposed within said light emitting end of said housing;

said light source assembly including a first light source;

a first circuit within said flashlight housing including means for interconnecting said first light source to a first rechargeable power source;

said light source assembly further including a second light source;

a second circuit within said flashlight housing independent of said first circuit and including a second, replaceable power source, separate from said first power source, adapted to be connected in circuit to said second light source; and a switch operative in a first position to energize said first light source, and operative in a second position to energize said second light source.

50. A flashlight comprising, in combination, a flashlight housing having a forward light emitting end and a rear end, a light source assembly disposed within said light emitting end of said housing;

said light source assembly including a first light source;

a first circuit within said flashlight housing including means for interconnecting said first light source to a first type of power source;

said light source assembly further including a second light source;

a second circuit within said flashlight housing independent of said first circuit and including a second type of power source, separate from said first type of power source, adapted to be connected in circuit to said second light source;

a switch operative in a first position to energize said first light source, and operative in a second position to energize said second light source, and one of said power sources being rechargeable and including a replaceable power pack.

51. A flashlight comprising, in combination, a flashlight housing having a forward light emitting end and a rear end, a light source assembly disposed within said light emitting end of said housing;

said light source assembly including a first light source;

a first circuit within said flashlight housing including means for interconnecting said first light source to a first type of power source;

said light source assembly further including a second light source;

a second circuit within said flashlight housing independent of said first circuit and including a second type of power source, separate from said first type of power source, adapted to be connected in circuit to said second light source;

a switch operative in a first position to energize said first light source, and operative in a second position to energize said second light source, one of said power sources being rechargeable, and one of said circuits including a recharging circuit for being operatively coupled to a source of AC power to facilitate charging of said rechargeable power source and including circuitry for automatically sensing application of either 120 volts AC or 220 volts AC to facilitate the proper charging of the rechargeable power source.

52. A flashlight comprising, in combination, a flashlight housing having a forward light emitting end and a rear end, a light source assembly disposed within said light emitting end of said housing;

said light source assembly including a first light source;

a first circuit within said flashlight housing including means for interconnecting said first light source to a first type of power source;

said light source assembly further including a second light source;

a second circuit within said flashlight housing independent of said first circuit and including a second type of power source, separate from said first type of power source, adapted to be connected in circuit to said second light source;

a slide switch slidably movable between at least two positions and operative in a first position to energize said first light source and de-energize said second light source, and operative in a second position to energize said second light source and de-energize said first light source.

53. The flashlight of claim 30 wherein said high intensity light source includes a Xenon lamp.

* * * * *